US005312109A

United States Patent [19]

Cagle

[11] Patent Number: 5,312,109

[45] Date of Patent: May 17, 1994

[54] SOCCER COURT

[76] Inventor: David G. Cagle, 29 W. 12th St., New York, N.Y. 10011

[21] Appl. No.: 719,022

[22] Filed: Jun. 21, 1991

[51] Int. Cl.[5] ..... A63B 71/02

[52] U.S. Cl. ..... 273/411; 472/92; 472/94

[58] Field of Search ..... 273/411; 472/92, 94

[56] References Cited

U.S. PATENT DOCUMENTS

| | | | |
|---|---|---|---|
| 959,973 | 5/1910 | Tomkins . | |
| 2,107,141 | 2/1938 | Colt | 189/1 |
| 2,823,034 | 2/1958 | Bingham | 273/95 |
| 3,779,547 | 12/1973 | Pappas | 272/3 |
| 3,872,623 | 3/1975 | Spaulding, Jr. | 273/411 X |
| 3,904,193 | 9/1975 | Patterson | 272/3 |
| 4,167,839 | 9/1979 | Nielsen | 52/105 |
| 4,203,594 | 5/1980 | Cagle | 273/411 |
| 4,284,277 | 8/1981 | Leonard et al. | 273/411 |
| 4,497,483 | 2/1985 | Ahlgren | 472/94 X |
| 4,927,134 | 5/1990 | Burley | 272/3 |

OTHER PUBLICATIONS

Brochure from Autograph Turf No Publication Date.
Brochure for Soccer Systems Inc. No Publication Date.
"Dips, Strikers Unveil Indoor Soccer" Washington Post, Jan. 5, 1978 p. C8.
"MISL Lacks Strategy, etc." Washington Post, Nov. 9, 1980 p. N14.
"Ice Hockey" Rules of the Game, p. 188 Dec. 1974.
United States Futsal Federation Laws of the Game ©1982.
Major Soccer League Rules of the Game. Date Unknown.

*Primary Examiner*—William H. Grieb
*Attorney, Agent, or Firm*—Davis Hoxie Faithfull & Hapgood

[57] ABSTRACT

A soccer court comprises a rectangular playing area approximately the size of a tennis court and preferably covered with artificial turf, an enclosing wall with goal openings in the end walls and goal nets disposed outside of the playing area. The enclosing wall is constructed of a plurality of rigid transparent panels held in place by horizontal and vertical supports. Player entry doors are provided in the enclosing wall. The goal may optionally be configured as an inverted U and/or provided with doors to fully or partially close the goal opening. A backstop net is provided above each end wall to block errant shots on the goals, and the playing area may be bisected to create two substantially square training areas.

38 Claims, 5 Drawing Sheets

SOCCER COURT

FIELD OF THE INVENTION

The present invention relates to the art of sports playing areas, and particularly to soccer fields and courts.

BACKGROUND OF THE INVENTION

Soccer is an increasingly popular sport in the United States, especially among young people. The availability of soccer fields, however, is a problem. This is understandable, since a conventional outdoor soccer field is very large, on the order of 120 yards ×75 yards, or roughly 9000 square yards, upon which only one game of soccer can be played at a time. It will be appreciated that allocation of such a large space raises issues of use and expense, particularly in urban settings, resulting in few proper soccer facilities there. City dwellers must often travel long distances to play soccer, and have limited opportunities to play once they locate a field. Educational institutions must also balance the allocation of such large spaces to soccer fields against competing athletic uses and building sites.

A conventional soccer game requires 22 players on the field. People who are interested in recreational play are disadvantaged because gathering that many people and coordinating them is often inconvenient. Many people interested in soccer are therefore relegated to constructing makeshift fields of smaller size to accommodate smaller groups, using whatever is at hand for goals, boundary lines, and the like. Much time is also spent chasing loose balls when they are kicked out of bounds. A ball kicked out of bounds can travel a great distance before coming to a stop.

A common training technique for soccer teams is to mark a square in which two or three players practice techniques. Since such squares are usually in the middle of an open field, much chasing around after loose balls is necessary, which is especially disadvantageous because of the waste of time in a scheduled practice session.

Another training technique employed by individuals or small numbers of soccer players is to kick the ball against a kickboard, which can consist of anything from a brick wall to a panel specially designed for such a purpose.

By their size and nature, conventional soccer fields are not portable. Portable soccer playing areas could be advantageously employed in order to accommodate a touring group or provide a demonstration, or to enable more than one community to share the cost of construction of a soccer playing area while also sharing its benefits.

OBJECTS AND SUMMARY OF THE INVENTION

It is therefore an object of the present invention to provide a self-contained and relatively small outdoor playing area for soccer, and one on which small groups can play with proper boundaries and goals.

It is also an object of the invention to provide a convenient and more accessible outdoor place to play soccer in urban or other developed areas, and to provide a soccer playing and practice facility that will be relatively unobtrusive and aesthetically acceptable to both observers and players, and which is suitable for placement in small and large parks.

It is a further object of the invention to provide a facility for playing soccer or performing drills where the time lost to chasing after loose balls will be minimized.

It is a further object of the invention to provide a facility that can conveniently be adapted for both team and individual soccer practice and for team competition.

It is yet another purpose of the invention to provide a soccer playing facility satisfying the above objects that is also portable, and suitable for indoor or outdoor installation.

In accordance with its principal aspects, one preferred embodiment of the invention is a soccer court comprising a substantially rectangular playing area with opposing end walls extending across the width of the playing area, rigid transparent side walls joining the end walls, a goal opening disposed in at least one of the end walls, and a goal net disposed behind the goal opening and outside of the playing area.

In a further preferred embodiment, the soccer court comprises a substantially rectangular playing area approximately 76 to 92 feet long and 32 to 44 feet wide, and enclosing side and end walls approximately 6 to 8 feet high surrounding the playing area, comprising a plurality of rigid transparent panels and supports for rigidly mounting the panels.

In a further specific embodiment, the soccer court comprises a first substantially square training area and a second substantially square training area disposed adjacent to the first training space thereby forming a substantially rectangular playing area. A wall is provided for selectively dividing the first and second training areas whereby training sessions or play may be carried out in each training area independent of the other. An enclosing wall is disposed outside of and near the boundaries of the playing area, whereby the enclosing wall does not interfere with training taking place in the training areas, but prevents errant balls from escaping from the training areas.

In another embodiment of the invention, the soccer court comprises a substantially rectangular playing area, two end walls extending across the width of the playing area, and two rigid transparent side walls connecting the end walls. A door is disposed in at least one end wall which door in the open position provides a goal opening and in the closed position provides a kickboard practice surface.

In a further preferred embodiment of the invention, a portable soccer court comprises a substantially rectangular playing area, an enclosing wall surrounding the playing area comprising a plurality of transparent panels and supports for mounting the panels, and a broad, heavy base attached to the supports instead of a permanent foundation, which renders the soccer court portable.

BRIEF DESCRIPTION OF THE DRAWINGS

These and other objects, aspects, and embodiments of the present invention will be described with reference to the following drawing figures, of which.

DETAILED DESCRIPTION OF THE INVENTION

Figure 1:
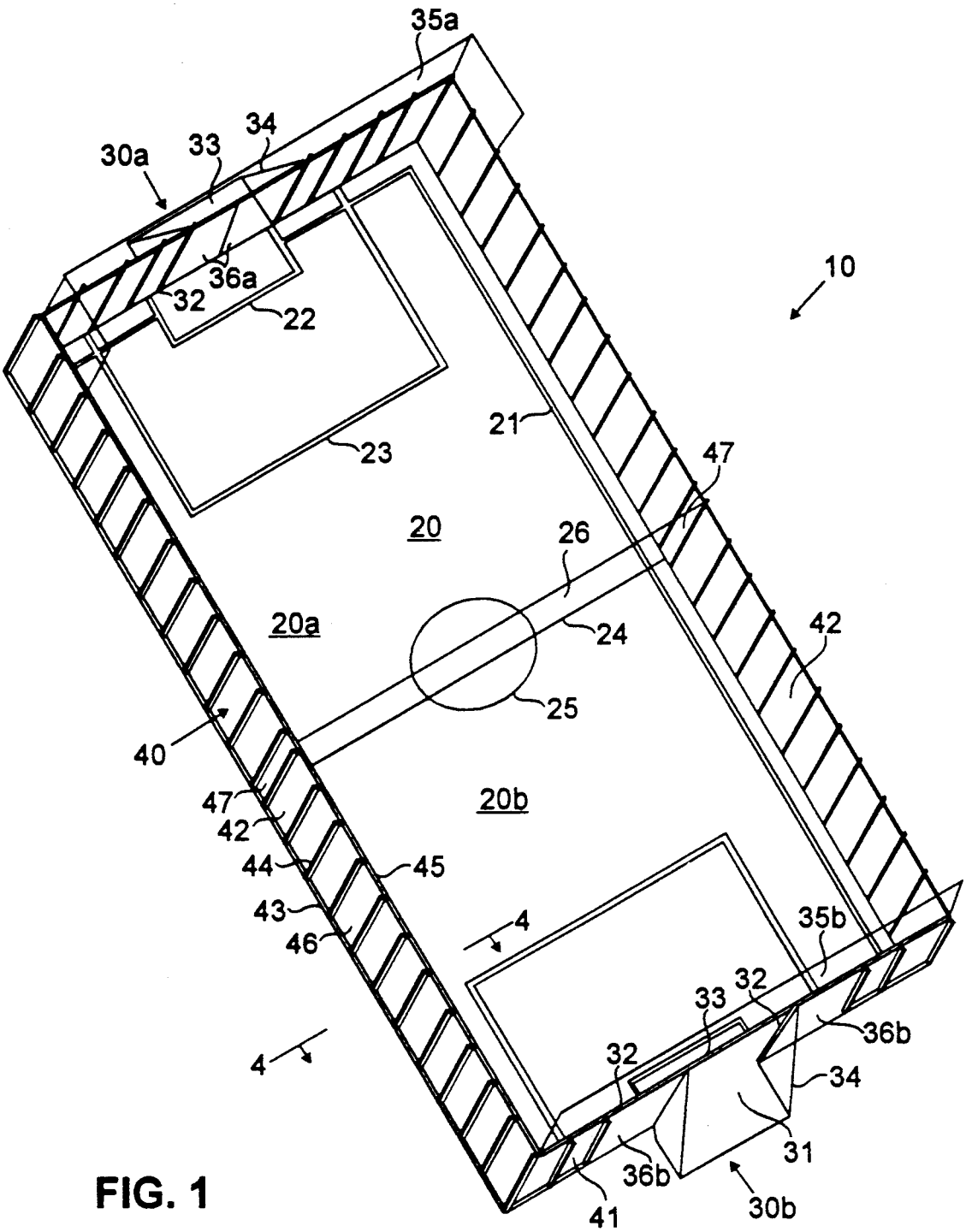
FIG. 1 is a perspective view of one embodiment of a soccer court according to the present invention.
Figure 2:
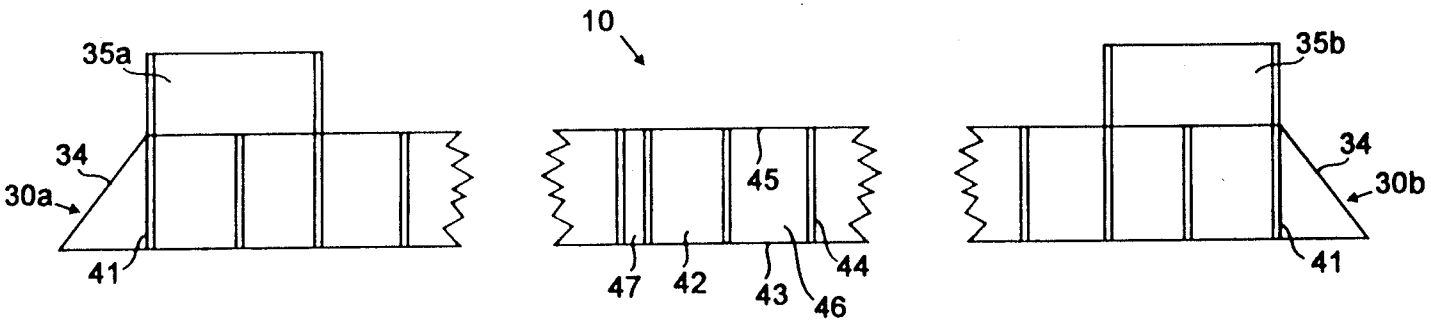
FIG. 2 is a side elevational view of the soccer court of FIG. 1.
Figure 3:
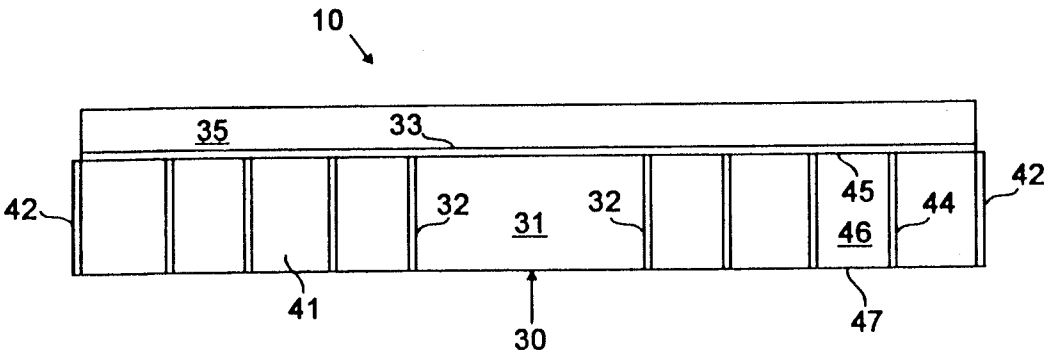
FIG. 3 is an end elevational view of the soccer court of FIG. 1.

Referring first to FIGS. 1 to 4, a preferred embodiment of the soccer court 10 according to the present invention comprises a substantially rectangular playing surface or area 20, two goals 30*a* and 30*b*, and an enclosing wall 40, comprising end walls 41 and side walls 42, disposed on the borders of the playing area 20. The playing area 20 is approximately 44 feet by 90 feet in the preferred embodiment, which is approximately the size of a conventional tennis court. Thus, a tennis court which is no longer used, or one used with diminishing frequency, can be converted into the soccer court 10 at minimum expense since the necessary space has already been allocated and the foundation has already been flattened and prepared.

The playing area 20 is disposed on a foundation 27 which may be covered by a variety of surfaces, including grass, clay, dirt, sand, concrete or asphalt, or artificial turf. It has been found that the latter is preferable because it adequately cushions players should they fall during play, and because it wears well and is relatively maintenance-free. Examples of suitable artificial turf include ASTROTURF® and AUTOGRAPH TURF®, manufactured by the Astroturf Company of St. Louis, Mo. Grass is less preferable since it wears quickly, especially where the play is confined to a small area. Concrete or asphalt is also less preferable, since such surfaces are more likely to injure a player in a fall. The playing surface 20 is sloped or crowned slightly in the preferred embodiment to provide more effective drainage.

The foundation 27 may comprise any suitable foundation known in the art, such as a concrete slab. The type of foundation will depend partially on the location; for example, if it is desired to erect the soccer court 10 on a beach (a common locale for impromptu soccer games), a preferred foundation would be a point foundation comprising concrete pier footings disposed underneath the wall 40, each footing being 12 to 18 inches in diameter and 4 to 6 feet deep.

The wall 40 comprises a plurality of rectangular panels 46 which are held in place by vertical structural members 44 and lower and upper horizontal structural members 43 and 45. In the preferred embodiment, the panels 46 are formed of rigid transparent material such as a clear polycarbonate. An example of the latter is LEXAN® material with MARGARD® surface treatment to provide a mar-resistant surface, manufactured by General Electric Corporation of Pittsfield, Mass., with the panels being at least approximately ½ inches thick in the preferred embodiment. It will be appreciated that the transparent wall panels 46 will make the soccer court 10 relatively unobtrusive and more aesthetically pleasing in an outdoor environment. A transparent wall will also make the players feel less closed in and provide for convenient outside coaching and spectating. The structural members 43, 44, and 45 are preferably constructed of extruded aluminum.

The wall 40 is approximately 6 feet-6 inches to 7 feet high in a preferred embodiment. However, it will be appreciated that the wall 40 may be of any height desired. For example, to decrease construction costs it may be desired to lower the height of the side walls 42 to, e.g., approximately 2 feet-6 inches since it is less likely that a ball will be kicked in the direction of, and thus escape over, the side walls 42 than the end walls 41. It may alternatively be desired to increase the height of the wall 40.

In a preferred embodiment, both the side and end walls are constructed of rigid transparent panels thereby maximizing the sense of openness, spectator opportunity, and overall aesthetic appearance of the soccer court. However, if desired, the end walls 41 can be constructed of other materials such as masonry or wood. The side walls 42 can also be constructed of other material, if desired.

In the preferred embodiment, the vertical members 44 are bolted to the foundation 27 by means of bolts or casing sleeves (not shown) which are cast into the foundation 27. Alternatively, the vertical members 44 can be secured to the foundation 27 by any other suitable means. The lower horizontal members 43 are bolted or welded or otherwise secured to the lower ends of the vertical members 44. The lower horizontal members 43 are U-shaped channels in the preferred embodiment, the rectangular panels 46 being placed between the upright arms of the channel. The lower horizontal members 43 are preferably disposed approximately ½ inch above the foundation 27 in one embodiment in order to allow for drainage. If desired, supports 49 can be placed at intervals between the lower horizontal members 43 and the foundation 27 and bolted into the latter to provide additional rigidity to the structure.

The upper horizontal members 45 are preferably U-shaped channels and are bolted or welded to the upper ends of the vertical members 44 in such a manner that the channel is inverted and fits over the top of the rectangular panels 46. The horizontal members 43 and 45 are approximately four inches deep in a preferred embodiment.

Figure 4:
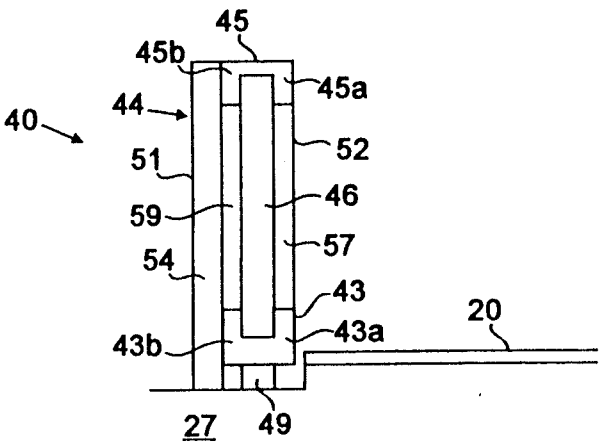
FIG. 4 is a cross-sectional view of the side wall along line 4—4 in FIG. 1.
Figure 4A:
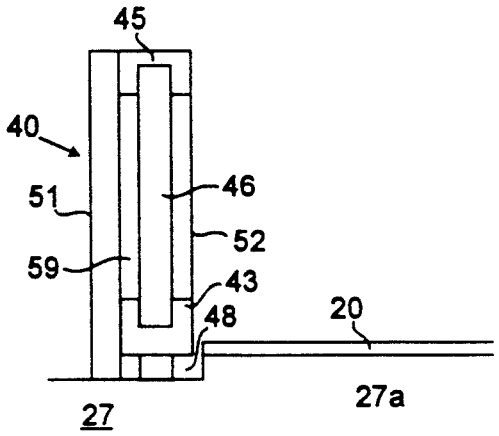
FIG. 4A is a cross-sectional view similar to FIG. 4 showing another embodiment.

FIG. 4A shows an alternative configuration to provide for drainage. In this embodiment, the foundation 27*a* under the playing surface 20 is raised slightly above the foundation 27*b* in the surrounding area. The raised playing surface 20 cooperates with a narrow drain channel 48 disposed between the playing surface 20 and the enclosing wall 40 to provide for drainage. The drain channel 48 is narrow, preferably one to three inches in width, so that should a player step on it, he will not turn his ankle or otherwise injure himself.

Figure 5A:
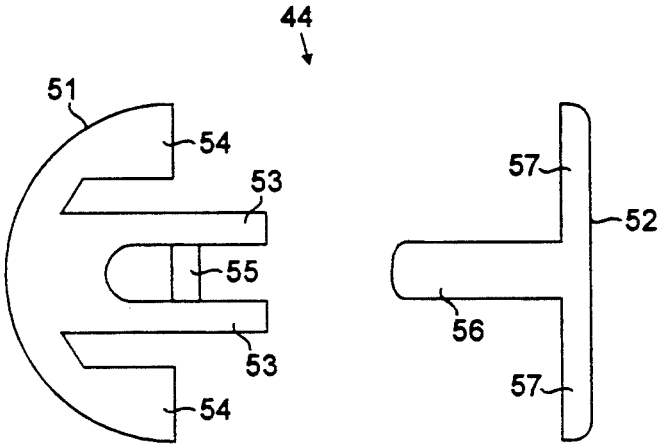
FIG. 5A is a top view of an embodiment of two elements which cooperate to form a vertical structural member of the enclosing wall of the soccer court of FIG. 1.
Figure 5B:
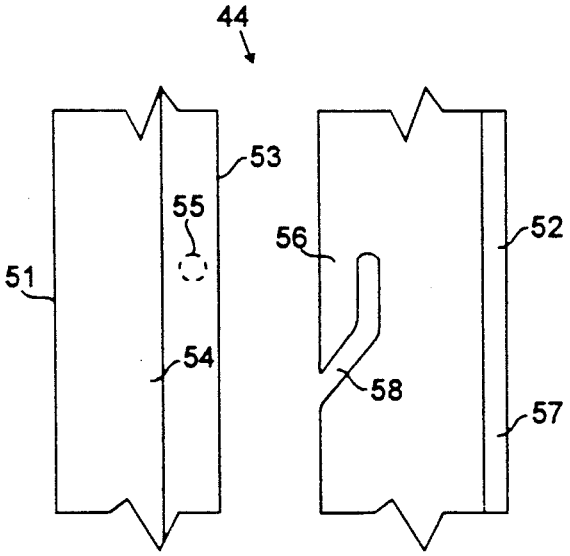
FIG. 5B is a partial side elevational view of the elements which cooperate to form the vertical structural member of FIG. 5.
Figure 6:
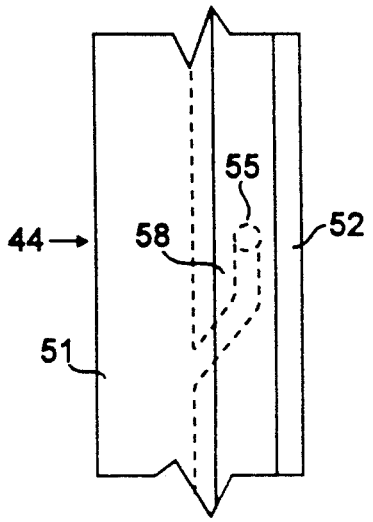
FIG. 6 is a partial side elevational view of the vertical structural member of FIG. 5B, showing the elements cooperatively engaged.

Referring now to FIGS. 5A, 5B and 6, there is illustrated one embodiment of a vertical structural member 44 which comprises a female connecting member 51 on the outside of the wall 40 and a mating T-shaped male connecting member 52 disposed on the inner side of the wall 40. A U-shaped receiving channel 53 extends along the length of the female connecting member 51 with two supports 54 protruding from its sides which face the male member 52. A latching pin 55 is disposed perpendicular to, and between the arms of, the channel 53.

The T-shaped male connecting member 52 comprises a leg 56 and flanges 57. A slot 58, adapted to cooperatively engage latching pin 55, is disposed in the leg 56. The lower open portion of the slot 58 is at an angle to the vertical and relatively wide, while its upper portion is vertical and narrows to approximate the cross-sectional diameter of pin 55, which is firmly seated in the top of slot 58 when the two elements are securely engaged.

The slanted lower portion of the slot 58 causes the male and female connecting members 52 and 51 to be drawn together as the latching pin 55 engages and enters the slot 58. As the male member 52 decends relative to the female member 51, the pin 55 enters the upper vertical portion of the slot 58, and the connecting members are locked together in an engaged relationship, as is shown in FIG. 6.

As can be seen in FIG. 4, the lower U-shaped horizontal member 43 is disposed at the lower end of the male connecting member 52 such that one arm **43*a* of the U-shaped channel is flush with the flanges 57 of male member 52. The other arm 43*b* is bolted, welded, or otherwise secured to the support 54 of the female connecting member 51. The upper U-shaped horizontal member 45 is oriented so that its open end faces downward and one arm 45*a* of the U-shaped channel is flush with the flanges 57 of the male member 52. The other arm 45*b* is secured to the support 54 of the female connecting member 51**.

Because of the location of the upper and lower horizontal members 43 and 45, a gap 59 equal in thickness to the arms **43*b* and 45*b* is created between the female connecting member 51 and the rectangular panel 46. In the preferred embodiment, the gap 59 is filled to ensure a flex-free fit between the panels 46 and the vertical member 44**, preferably with a strip of neoprene or like material.

It will be appreciated that the flanges 57 of the male connecting member 52 and the arms **43*a* and 45*a* of the lower and upper horizontal members protrude into the playing area 20 from the plane of the rectangular panels 46, causing the enclosing wall 40 to not be entirely smooth and flat. The interior surface of the wall can be made substantially flat or even, if desired, by casting the panels 46 with an appropriate recess along their edges, or by appropriately routing the edges of the panels to accommodate the retaining flanges and arms of the vertical and horizontal members. The same procedure may be followed to eliminate the gap 59**, if desired.

In a preferred method of construction of the wall 40, the vertical female connecting members 51 are bolted or otherwise secured to the foundation 27, and the arms **43*b* of the lower horizontal members 43 are bolted or otherwise secured to the lower portion of the vertical female members 51, and secured to the foundation 27 with supports 49. The panels 46 are then placed into the lower horizontal U-shaped channel members 43, and the gap 59 is filled. The vertical male connecting members 52 are then placed in engaging relationship with the female members 51 in the manner described above, and the arms 45*b* of the upper horizontal members 45 are bolted or otherwise secured to the upper portion of the vertical female members 51** to complete construction.

Figure 7:
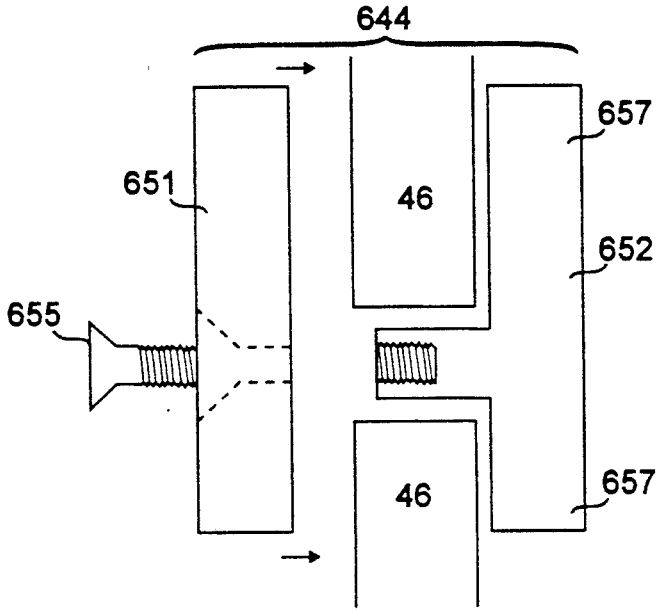
FIG. 7 is a top view of another embodiment of two elements which cooperate to form a vertical structural member of the enclosing wall of the soccer court of FIG. 1.

FIG. 7 shows another embodiment of a vertical structural member 644, which comprises an outside connecting member 651 and an inside connecting member 652. The outside member 651 comprises a piece of rectangular tubing, while the inside T-shaped member 652 comprises a leg 656 and flanges 657, similar to the male connecting member 52 of FIGS. 5 to 7. The outside and inside connecting members 651 and 652 are secured to each other by bolts 655 or other fasteners in order to retain the panels 46 and upper and lower horizontal members 45 and 43. The outer surface of member 651 is rounded to eliminate sharp projecting corners. Alternative forms of structural members and means of securing the wall panels will be apparent to those skilled in the art.

Referring again to FIGS. 1 to 3, player entrance doors 47 are disposed in side walls 42. The doors 47 are preferably constructed of transparent panels like the rest of the wall 40, and can be two feet wide. The doors are hung on adjacent vertical structural members by any suitable means, such as hinges. The precise location and number of the doors in the enclosing wall 40 is not critical.

The goals **30*a* and 30*b* each comprise a goal opening 31 formed in the end walls 41. In a preferred embodiment, each goal opening 31 is the same height as the end wall, i.e., six feet-six inches high, and is approximately twelve feet wide and framed by rigid sidebars 32 and a rigid crossbar 33. A goal net 34 is disposed behind the goal opening 31 and outside of the playing area. The edges of the goal net 34 are securely attached to the sidebars 32 and the crossbar 33 by any suitable means to form a ball retaining recess behind the plane of the end wall 41**.

A rectangular backstop retention net **35*b* is disposed above the end wall 41 to prevent errant balls, especially those kicked at the goals which are too high to enter, from escaping the soccer court 10. The net 35*b* can be from 6 to 10 feet high. In another embodiment, a backstop retention net 35*a* is positioned above the end wall 41 and also further extends above sections of the adjacent side walls 42** to deflect balls back into the enclosure.

Optionally, doors **36*b* can be used to close the opening of goal 30*b* to create a kickboard practice area. In one embodiment, the doors 36*b* are hinged to the sidebars 32 and disposed outside the soccer court 10. The doors 36*b* are closed by removing the goal net 34** and swinging the doors to a coplaner position with the end walls.

Alternative means can be used to close the goal opening 31 to create a kickboard practice area. For example, as illustrated in FIG. 1, the doors can comprise portable panels that can be placed in the goal opening 31 without having to remove the goal net 34. Other means can include bifolding doors which may fit into the goal net in the open position or sliding panels.

The doors 36*a* and 36*b* can be used to create a smaller goal by closing only one door, turning half of the goal opening into a kickboard while leaving the other half open. Such an arrangement is useful for practicing precise goal shots.

Outer boundary lines 21 can be marked on the playing surface 20 one or two feet from the side walls 42 and along the end walls 41 to the edges of the goals 30. The boundary lines 21 are optional; soccer can be played in the soccer court 10 either by using the boundary lines or by playing the ball off the enclosing wall 40. Even if the boundary lines are not used during games, they may be useful during drills, as discussed below. Lines are also marked on the playing surface 20 to form goal boxes 22 and larger penalty areas 23 immediately in front of the goals 30. A center line 24 and kickoff circle 25 can also be marked in the middle of the playing surface 20.

As shown in FIG. 1, an optional central divider 26 can be disposed over the center line 24 to divide the playing area 20 into two substantially square training areas 20*a* and 20*b*, permitting simultaneous use of the facility for two training sessions. The divider 26 is approximately 6 feet-6 inches high in a preferred embodiment. The divider 26 is attached to the side walls 42 by any suitable means, and need not be at the center of the playing area 20 if, for example, it is desired to attach it to one of the vertical supports 44 adjacent to the entry doors 47. The divider 26 is a net in the preferred embodiment, but may comprise rigid boards or panels which, in cooperation with the doors 36*a* and 36*b*, would permit the entire periphery of each training area 20*a,b* to be used as a kickboard practice area. A door or other means for passage may be provided in the divider 26 to allow players to pass from one training area to another; for example, if the divider 26 is a net, the passage may comprise a flap attached with hook and loop VELCRO ® fasteners.

A common drill for players in training is to mark a square and conduct drills inside of it. The installation of a divider 26 creates two such training areas, using the boundary lines 21 and center line 24 for the training areas. In addition, balls kicked outside of the boundary lines 21 during such training do not have to be chased down since they will merely rebound from the wall 40.

Figure 8:
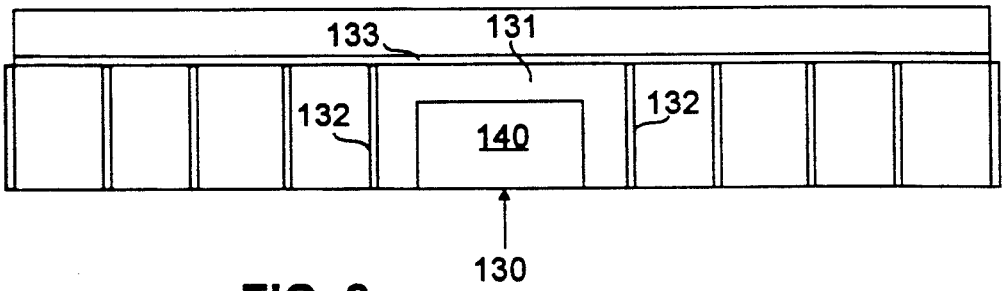
FIG. 8 is a front elevational view of an end wall showing another embodiment of a soccer goal according to the invention.

Referring to FIG. 8, a second embodiment of a soccer goal 130 is shown. The goal 130 can be the same size in its outer dimensions as the goals 30*a*, or larger if it is desired to approximate the size of a regulation outdoor soccer goal. Overall, the goal 130 takes the shape of an inverted U. A rectangular blocking panel 140 is disposed in the center of the goal 130, leaving a goal opening 131 between the panel 140 and the sidebars 132 and crossbar 133 which define the outer dimensions of the goal 130. A goal net is secured behind the goal opening 131 as described above to retain balls kicked into the goal. The configuration of the goal 130 is intended to make scoring more challenging, and provides good practice for placing the ball into the upper and side areas or corners of the goal where the ball is less likely to be blocked by the goalkeeper. In addition, the difficulty of kicking a ball into the goal 130 allows effective play without a goalkeeper.

Figure 9:
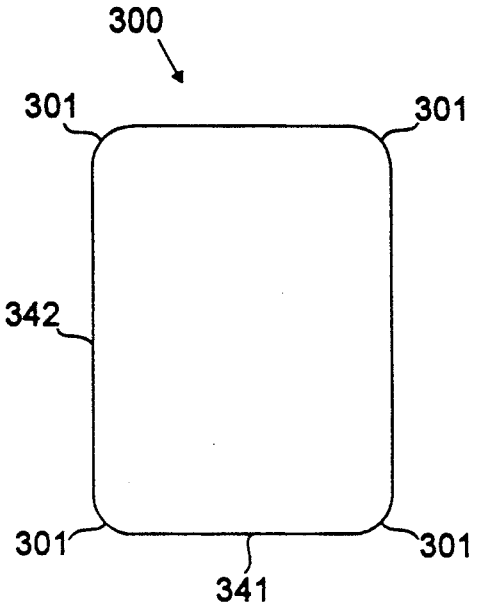
FIG. 9 is a plan view of another embodiment of a soccer court according to the invention.
Figure 10:
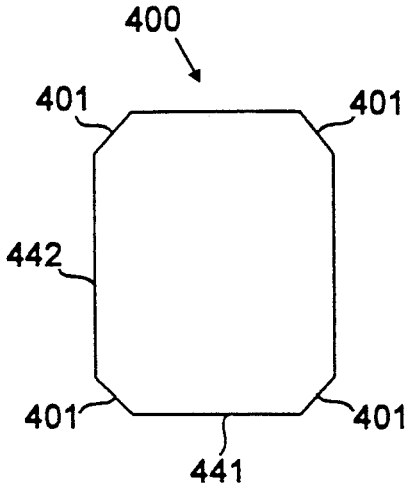
FIG. 10 is a plan view of a further embodiment of a soccer court according to the invention.

Referring to FIG. 9, another embodiment of a soccer court 300 according to the invention is shown. The soccer court 300 is similar to the soccer court 10, except that the side and end walls 342 and 341 are joined by curved panels 301. This configuration can be used to preclude trapping of the soccer ball which may occur in a corner of the rectangular playing area of the soccer court 10. FIG. 10 shows a further embodiment of a soccer court 400 according to the invention in which the side and end walls 442 and 441 are joined by diagonal panels 401. The use of diagonal panels instead of the curved panels of FIG. 9 may be preferred for ease of manufacture and installation.

Figure 11:
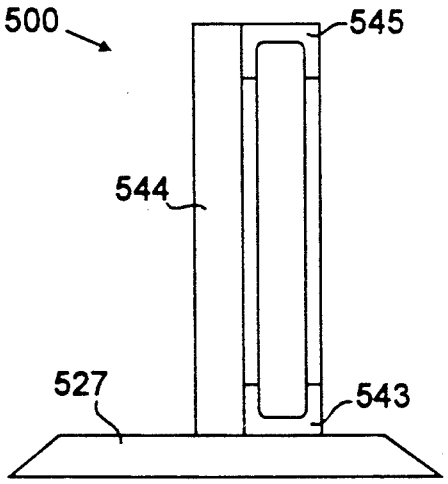
FIG. 11 is a side elevational view in cross-section of the wall of a portable soccer court according to the invention.

The basic features of the invention described above can be readily adapted to provide a portable soccer court having the same advantages with only minor modifications. Referring to FIG. 11, the wall of a portable soccer court 500 is shown in cross-section. The vertical member 544 and lower horizontal member 543 are attached to a heavy and broad base 527 approximately three feet in width instead of to a permanent foundation. The base 527 may be moved from place to place, as desired. Sufficient width and weight of the base 527 can be selected to stabilize the wall 540, or the base 527 can additionally be secured to the ground, or to a floor if the portable soccer court is to be installed indoors. The portable soccer court 500 can be assembled from the same elements as described above in conjunction with the permanent installations. As will be apparent to one skilled in the art, the court 500 can be divided into component parts that can be moved by hand or appropriate mechanical equipment in order to facilitate its disassembly, transportation, and relocation to another site.

It will be understood that the foregoing description describes only a few of the specific embodiments which are illustrative of the present invention, and that the disclosed embodiments may be modified in various ways, e.g., by changing the location of the entry doors, varying the height of the enclosing wall and the size of the goals, changing the structure of the wall, varying the markings on the playing surface, and by adding lighting fixtures. Other variations and modifications will be apparent to those skilled in the art. The invention is defined by the following claims:

What is claimed is:

1. A soccer court comprising:

a substantially rectangular playing area approximately 76 to 92 feet long and 32 to 44 feet wide, said playing area covered with material selected from grass and artificial turf;

side and end walls enclosing said playing area, wherein said walls comprise a plurality of vertical rigid transparent panels extending from proximate the horizontal surface of the playing area to a height of approximately 6 to 8 feet, said panels permitting an unobstructed view of the playing area, and supports for rigidly mounting said panels;

a goal opening disposed in each end wall;

and a goal net disposed behind each of said goal openings and outside said playing area.

2. The soccer court of claim 1 wherein said transparent panels are substantially rectangular, approximately seven feet high, four feet wide, and at least ½ inches thick.

3. The soccer court of claim 1 wherein the transparent panels are constructed of transparent polycarbonate material.

4. The soccer court of claim 3 wherein the panels are treated to provide a mar-resistant surface.

5. The soccer court of claim 1 wherein said supports comprise a plurality of upper horizontal structural members, lower horizontal structural members, and vertical structural members, arranged to form a plurality of rectangular openings, and wherein said transparent panels are placed in said rectangular openings and are secured in place by said supports.

6. The soccer court of claim 6 wherein said lower horizontal structural members are elevated above the playing surface to permit drainage.

7. The soccer court of claim 1 further comprising an entry door disposed in said enclosing wall for ingress and egress of players.

8. The soccer court of claim 1 further comprising a broad, heavy base attached to said supports.

9. The soccer court of claim 1 wherein said enclosing wall has a substantially smooth interior surface.

10. The soccer court of claim 1 wherein said playing area is approximately 90 feet long and approximately 44 feet wide.

11. The soccer court of claim 1 wherein the outer periphery of said goal opening is defined by two vertical sidebars and an upper crossbar, and wherein the inner dimensions of said goal opening are defined by a rectangular panel in contact with the surface of the playing area and substantially centered within said outer periphery, so that said goal opening is shaped substantially as an inverted U.

12. The soccer court of claim 1 further comprising a backstop retention net disposed vertically above the end wall containing the goal opening.

13. The soccer court of claim 1 further comprising a backstop retention net running along the end wall containing the goal opening and further along part of the adjacent side walls.

14. The soccer court of claim 1 where the playing area has a crown.

15. The soccer court of claim 1 wherein said side walls are elevated above the surface of the playing area to facilitate drainage.

16. The soccer court of claim 1 further comprising a narrow drain channel disposed between said playing are and said side walls to facilitate drainage of said playing area.

17. The soccer court of claim 1 further comprising:

a first substantially square training area;

a second substantially square training area disposed adjacent to said first training area, said training areas occupying the substantially rectangular playing area;

means for selectively separating said first and second training areas whereby training sessions or play can be carried out in each training area independent of the other; and wherein the enclosing wall is disposed outside of and proximate the boundaries of said playing area, whereby said enclosing wall does not interfere with training taking place in said training areas, but prevents errant balls from leaving said training areas.

18. The soccer court of claim 17 wherein the training areas are approximately 45 feet square.

19. The soccer court of claim 17 further comprising means for closing at least one of said goal openings to create a kickboard practice area.

20. The soccer court of claim 17 wherein said goal opening is in the shape of an inverted U.

21. The soccer court of claim 17 further comprising means for preventing balls kicked above said goal opening from leaving said soccer court.

22. The soccer court of claim 21 wherein said means for preventing balls from leaving said soccer court comprises a net supported above the enclosing wall.

23. The soccer court of claim 17 wherein the surface of said playing area is covered by artificial turf.

24. The soccer court of claim 1 further comprising:

at least one door disposed in an end wall which door in the open position provides the goal opening and in the closed position provides a kickboard practice surface.

25. The soccer court of claim 24 wherein said playing area is approximately the size of a conventional tennis court.

26. The soccer court of claim 24 wherein said at least one door comprises a removable panel.

27. The soccer court of claim 24 wherein said at least one door opens outwardly away from the playing area and closes inwardly toward the playing area.

28. The soccer court of claim 24 further comprising a first door and a second door adjacent to said first door, whereby a fully open goal opening is provided when said first and second doors are in the open position, and whereby a half open goal opening is provided when either of said first and second doors are in the open position while the other is in the closed position.

29. The soccer court of claim 24 wherein said playing area comprises two adjacent substantially square training areas, and further comprising a divider disposed between said training areas.

30. The soccer court of claim 4 wherein the side and end walls are joined by curved panels.

31. The soccer court of claim 4 wherein the side and end walls are joined by diagonal panels.

32. A soccer court comprising:

a substantially rectangular playing area, approximately 90 feet long and 44 feet wide;

an enclosing wall approximately 7 feet high which surrounds said playing area and comprises two end walls extending across the width of said playing area, and two side walls connecting said end walls along the length of said playing area, said enclosing wall being constructed of a plurality of upper horizontal supports, vertical supports, and lower horizontal supports proximate the surface of the playing area, which together form a plurality of rectangular openings into a plurality of rigid transparent panels are secured;

a goal opening approximately 6 feet-6 inches high and 12 feet wide disposed in each end wall and a goal net disposed behind each goal opening.

33. The soccer court of claim 32 further comprising a portable wall for selectively dividing said playing area into two substantially square training areas.

34. The soccer court of claim 32 further comprising backstop retention nets approximately 6 to 10 feet in height disposed above said end walls.

35. The soccer court of claim 32 further comprising panels for selectively closing said goal openings to form a kickboard practice area.

36. The soccer court of claim 32 further comprising means for illuminating said soccer court.

37. A soccer court comprising:

a substantially rectangular playing area approximately the size of a conventional tennis court, said playing area covered with material selected from grass and artificial turf;

side and end walls enclosing said playing area, wherein said walls comprise a plurality of vertical rigid transparent panels extending from proximate the horizontal surface of the playing area to a height of approximately 6 to 8 feet, said panels permitting an unobstructed view of the playing area, and supports for rigidly mounting said panels;

a goal opening disposed in each end wall;

and a goal net disposed behind each of said goal openings and outside said playing area.

38. A soccer court comprising:

a substantially rectangular playing area, the size of a tennis court;

an enclosing wall approximately seven feet high which surrounds said playing area and comprises two end walls extending across the width of said playing area, and two side walls connecting said end walls along the length of said playing area, said enclosing wall being constructed of a plurality of upper horizontal supports, vertical supports, and lower horizontal supports, which together form a plurality of rectangular openings into which a plurality of rigid transparent panels are secured;

a goal opening approximately six feet-six inches high and twelve feet wide disposed in each end wall and a goal net disposed behind each goal opening.

* * * * *

UNITED STATES PATENT AND TRADEMARK OFFICE

CERTIFICATE OF CORRECTION

PATENT NO. : 5,312,109

DATED : May 17, 1994

INVENTOR(S) : Cagle

It is certified that error appears in the above-identified patent and that said Letters Patent is hereby corrected as shown below:

Claim 6, column 9, line 5, "of claim 6", should be -- of claim 5 --.

Claim 16, column 9, line 40, change "are" to -- area --.

Claim 30, column 10, line 30, "of claim 4" should be -- of claim 24 --.

Claim 31, column 10, line 32, "of claim 4" should be -- of claim 24 --.

Claim 32, column 10, line 46, after "into", insert -- which --.

Claim 38, column 11, line 10, after "area", insert -- approximately --.

Claim 38, column 11, line 11, after "a", insert -- conventional --.

Signed and Sealed this

Thirtieth Day of August, 1994

*Attest:*

*Attesting Officer*

Bruce Lehman

BRUCE LEHMAN

*Commissioner of Patents and Trademarks*